US008162107B2

(12) United States Patent
Finkbeiner

(10) Patent No.: US 8,162,107 B2
(45) Date of Patent: Apr. 24, 2012

(54) LOAD SUSPENSION MEANS FOR A LIFTING APPARATUS

(76) Inventor: Gerhard Finkbeiner, Freudenstadt (DE)

( * ) Notice: Subject to any disclaimer, the term of this patent is extended or adjusted under 35 U.S.C. 154(b) by 179 days.

(21) Appl. No.: 11/897,011

(22) Filed: Aug. 28, 2007

(65) Prior Publication Data

US 2008/0060880 A1 Mar. 13, 2008

(30) Foreign Application Priority Data

Sep. 7, 2006 (DE) ..... 20 2006 013 854 U

(51) Int. Cl.

| | |
|---|---|
| ***B66F 9/12*** | (2006.01) |
| ***B66F 9/14*** | (2006.01) |
| ***B66F 7/28*** | (2006.01) |
| *B66F 5/00* | (2006.01) |

(52) U.S. Cl. ..... 187/237; 414/667; 254/2 B

(58) Field of Classification Search ..... 187/204, 187/210, 213, 216, 218, 219, 237, 238, 244; 414/607, 785, 631, 778, 667; 254/2 B, 7 B; *B66F 7/16, 7/20, 7/28, 9/12, 9/14*

See application file for complete search history.

(56) References Cited

U.S. PATENT DOCUMENTS

| | | | | | |
|---|---|---|---|---|---|
| 2,455,432 | A | * | 12/1948 | Martin | 187/253 |
| 2,659,506 | A | * | 11/1953 | Watkins | 414/785 |
| 3,203,568 | A | * | 8/1965 | Quayle | 414/621 |
| 3,232,380 | A | | 2/1966 | Hansen | |
| 3,356,241 | A | * | 12/1967 | Varilek | 414/671 |
| 3,851,779 | A | | 12/1974 | Crawford | |
| 3,908,844 | A | * | 9/1975 | Duffield | 414/724 |
| 4,113,128 | A | * | 9/1978 | Foss | 414/785 |
| 4,221,535 | A | * | 9/1980 | Quinn | 414/785 |
| 4,488,422 | A | * | 12/1984 | Wolf et al. | 72/377 |
| 4,488,832 | A | * | 12/1984 | Kinshofer | 403/316 |
| 4,568,217 | A | * | 2/1986 | Forsman et al. | 403/322.1 |
| 4,688,981 | A | | 8/1987 | Ravnsborg et al. | |
| 4,764,082 | A | * | 8/1988 | Quinn | 414/785 |
| 5,174,414 | A | * | 12/1992 | Burns | 187/210 |
| 5,692,872 | A | * | 12/1997 | Raben | 414/607 |
| 5,975,495 | A | * | 11/1999 | Berends et al. | 254/2 B |

(Continued)

FOREIGN PATENT DOCUMENTS

| | | | | |
|---|---|---|---|---|
| DE | 10140238 | A1 | | 3/2003 |
| JP | 05162997 | A | * | 6/1993 |
| JP | 2005225614 | A | * | 8/2005 |

OTHER PUBLICATIONS

American Psychological Association (APA): delimit. (n. d.). Dictionary.com Unabridged. Retrieved Nov. 29, 2010, from Dictionary.com website: http://dictionary.reference.com/browse/delimit.*

*Primary Examiner* — Emmanuel M Marcelo
*Assistant Examiner* — Stefan Kruer
(74) *Attorney, Agent, or Firm* — Kriegsman & Kriegsman

(57) ABSTRACT

The invention relates to a load suspension means for a lifting apparatus (11), which can be fitted on a lifting column (16) of the lifting apparatus (11) and has a transverse support (24) and at least one load suspension element (26) which is arranged thereon and is provided in a manner such that it can be displaced along the transverse support (24) for adjustment to a load suspension point on an object to be raised, wherein, for adjustment to the load suspension point, the at least one load suspension element (26) can be transferred by a pivoting movement, which is delimited by a lift-off safeguard (56), from and into a secured load suspension position without a tool.

18 Claims, 3 Drawing Sheets

Figure 1:
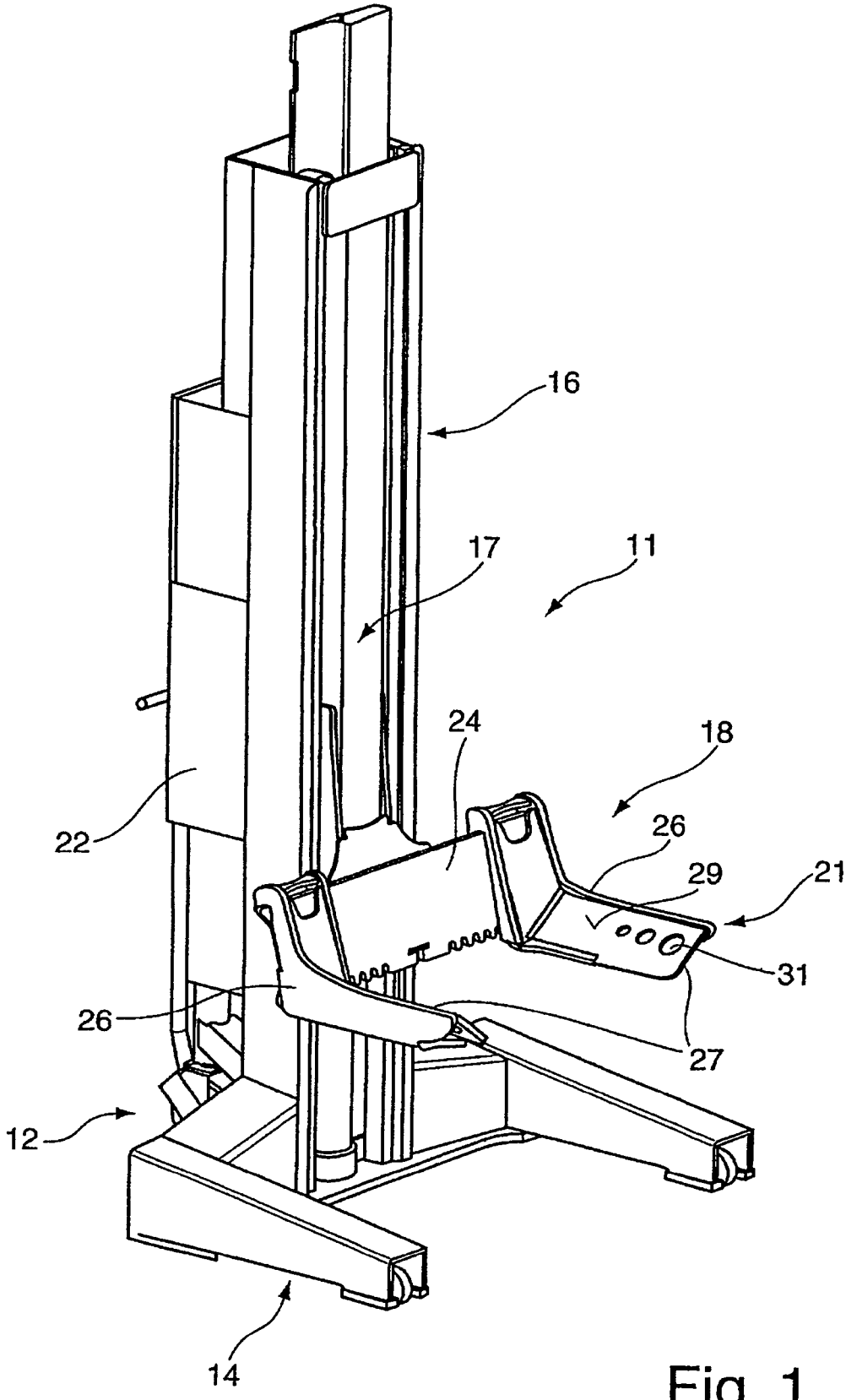

U.S. PATENT DOCUMENTS 6,287,073 B1 * 9/2001 Lindgren et al. ..... 414/785
6,315,079 B1 * 11/2001 Berends et al. ..... 187/210
6,368,050 B1 * 4/2002 Currie et al. ..... 414/785
D589,672 S * 3/2009 Finkbeiner ..... D34/35
7,500,816 B2 * 3/2009 Berends et al. ..... 414/458
2002/0025246 A1 * 2/2002 Lindgren et al. ..... 414/785
2006/0151250 A1 7/2006 Tyree
2008/0135341 A1 * 6/2008 Pollard ..... 187/237

* cited by examiner

LOAD SUSPENSION MEANS FOR A LIFTING APPARATUS

The invention relates to a load suspension means for a lifting apparatus according to the precharacterizing clause of Claim 1.

DE 101 40 238 A1 discloses a lifting apparatus, in particular mobile lifting apparatus, which is provided for lifting loads, vehicles or the like. Said lifting apparatus comprises a basic framework which is preferably equipped with a steerable moving mechanism. A lifting unit which comprises a lifting column in which a drive unit is arranged is provided on the basic framework. Said drive unit transfers a load suspension means from an inoperative position into a working position. A control unit is provided on the lifting column and is connected to a further lifting apparatus or to a central control unit by supply lines. The load suspension means on the lifting apparatus comprises a transverse support on which two load suspension elements or wheel-gripping elements are arranged. To secure the position set, it is necessary for a screw connection to be fitted with a tool. This arrangement requires a tool in order to adjust the load suspension elements.

The load suspension elements may alternatively also be secured in their load suspension position by plug-in bolts. Such an embodiment has the disadvantage that the plug-in bolts themselves require additional securing against automatic release, and such plug-in bolts may be mislaid when changing the position of the load-bearing forks.

The invention is therefore based on the object of providing a load suspension means which enables for a simple and rapid changing of the load suspension position of the load suspension element with respect to the transverse support.

This object is achieved according to the invention by the characterizing features of Claim 1. Further advantageous refinements and developments are provided in the further claims.

By a pivoting movement, which is delimited by a lift-off safeguard, of the load suspension element with respect to the transverse support, it is possible for the load suspension element to be able to be transferred from and into a secured load suspension position without a tool. This makes rapid adjustment of a desired position of the load suspension element on the transverse support possible. After the load suspension element comes free from its secured load suspension position by the pivoting movement, the load suspension element can be changed in its position along the transverse support. After the desired position is reached, the load suspension element is transferred into a secured load suspension position by a reversal of the pivoting movement. The assistance of tools is not required. Furthermore, it is not necessary to additionally install and remove plug-in and/or securing elements which, if incorrectly handled, make it impossible for the load suspension position to be correctly secured.

It is preferably provided for the load suspension element and the transverse support each to have at least one retaining element which engage in a form-fitting manner in one another in a secured load suspension position. The retaining elements are arranged fixedly on the load suspension element and the transverse support and are therefore captive. The form-fitting engagement in one another permits simple release and, when said elements are brought together, an alignment in a designated load suspension position such that a defined position of the load suspension element with respect to the transverse support is taken up. Such a form-fitting engagement in one another guards against at least a lateral displacement of the load suspension element. This has the advantage, in particular in the case of a load suspension means with wheel-gripping elements of fork-shaped design, that two wheel-gripping elements acting on a wheel do not increase their distance from each other, and act securely on the wheel.

It is preferably provided that the retaining element of the transverse support is designed as a U-shaped recess which is open at the edge and in which a retaining element of the load suspension element, which retaining element is designed as a cam, engages. This permits simple and cost-saving production. At the same time, simple geometrical conditions are provided making it possible for the load suspension element to be rapidly put into and rapidly released from the load suspension position.

As an alternative, it can be provided that, instead of the U-shaped recesses, round holes are provided in the transverse support, into which a retaining element, which is designed as a conical peg and is provided on the load suspension element, engages.

An advantageous refinement of the retaining elements of the support provides that the U-shaped recesses are provided on a lower, horizontally running section of the transverse support and form a position-securing region. The U-shaped recesses are preferably arranged at regular distances from one another, and therefore a grid-like adjustment of the distance of two or more load suspension elements with respect to one another on the transverse support is possible.

The retaining elements, designed as cams, on the load suspension element preferably have side surfaces which are oriented parallel to the long limbs of the U-shaped recesses and are designed for bearing against them. This makes it possible for transverse forces, when the load suspension elements are subjected to a load, to be able to be reliably absorbed and for a displacement of the load suspension elements during operation to be prevented.

The load suspension element acts on an upper supporting region of the transverse support with a hook-in region which makes it possible for, opposite thereto, a supporting section assigned to the position-securing region to be provided pivotably with respect to the transverse support. A pivot axis for the load suspension element on the supporting region is thus formed. By slight raising of a free end on the load suspension element or of a free end on a load-bearing fork, the load suspension element is unlocked or comes free from the load suspension position, and the load suspension element can be displaced longitudinally with respect to the transverse support. After the desired position of the load suspension element with respect to the transverse support is set, lowering of the load suspension element on account of its dead weight enables a secured load suspension position to be taken up again. Owing to this arrangement, a self-securing load suspension position is provided, and therefore the secured position is maintained without additional assistance.

Furthermore, it is advantageously provided that the retaining element of the load suspension element protrudes in relation to the supporting section in the direction of the position-securing region. This provides a secure engagement on the transverse support. The retaining element preferably protrudes by the thickness of the, in particular plate-like, transverse support, and therefore, when transverse forces occur, sheetlike contact is provided between the cam-shaped retaining element and the U-shaped recess.

The lift-off safeguard advantageously has an L-shaped design and is oriented in a mirror-inverted manner with respect to the hook-in region of the load suspension element. This makes it possible for the transverse support on the supporting region and position-securing region to be securely engaged around against release of the transverse support and for the load suspension element still to be displaceable longitudinally with respect to the transverse support.

A further reduction in the number of parts for the configuration of a load suspension means is preferably provided by the retaining element and the lift-off safeguard being designed as a single part. This single-part configuration makes it possible for the production process for the lift-off safeguard and the retaining element to be reduced from two to one. Furthermore, simple and rapid fastening is made possible.

A distance between the lift-off safeguard from the lower edge of the transverse support is advantageously designed to be smaller than an engagement depth of the hook-in region which acts on the upper edge of the transverse support. As a result, when the load suspension element is raised in order to unlock the load-securing position, an unhooking of the hook-in region at the upper edge of the transverse support or of the supporting region of the transverse support is prevented.

According to a further advantageous refinement of the invention, it is provided that the lift-off safeguard ensures that the supporting section on the load suspension element lifts off from a position-securing region of the transverse support in such a manner that the retaining element comes free from the U-shaped recess and the load suspension element can be displaced along the transverse support and further lifting off of the supporting section is prevented. A short limb of the lift-off safeguard, which is of L-shaped design, engages behind the transverse support, whereby the L-shaped, engaging-behind section of the lift-off safeguard and an end side of the retaining element on the load suspension element being arranged at a distance from each other which corresponds at least to the thickness of the transverse support, which is preferably designed as a plate, and is designed to be only slightly larger, so that a simple displacement without catching is possible.

It is preferably provided that the pivoting movement for the tool-free transfer of the load suspension means from a secured position into an unsecured position and vice versa takes place about a pivot axis which is formed by the hook-in region of the load suspension element on the supporting region of the transverse support, the pivot axis running parallel to the supporting region or lying in the plane thereof. As a result, an unlocking can take place by simply raising the free tip of the load suspension element.

The pivoting movement of the load suspension element in order to transfer it into an unsecured load suspension position for the displacement of the load suspension element along the transverse strut preferably lies in a region of between 0.5° and 20°. As a result, even a slight raising may be sufficient in order for the load suspension element to come free from the secured position. Owing to the load suspension element which is designed in an L-shaped manner, a lever action is produced which makes operation and raising easier.

According to a further advantageous refinement of the invention, it is provided that the transverse support at the outer end in each case of the supporting region has a releasable lock. This may be, for example, a screw or clamping connection. After said lock is released, the load suspension element can be completely removed from the transverse support. Otherwise, the load suspension element is secured with respect to the transverse support when the lock is present.

According to a preferred refinement of the invention, it is provided that two load suspension elements which are designed with load suspension forks and the distance between which can be adjusted to the size of a wheel are provided on the transverse support. As a result, the lifting apparatus is designed as a mobile hoisting device for use together with further lifting apparatuses in order to raise multi-axle vehicles.

The load suspension forks are preferably formed as a right and a left load suspension element and each have receiving surfaces directed towards each other. This makes it possible to center the wheel or further objects with respect to the load suspension means.

It is preferably provided that the receiving surface of the load suspension forks has holes. This permits improved engagement on the wheel. In addition, a reduction in the dead weight of the load suspension elements can be obtained. As an alternative, the load suspension surface may also have profilings.

According to a further advantageous refinement of the invention, it is provided that the load suspension element has a left and a right plate-like retaining profile on each of which a hook-in region is provided for engagement on the supporting region of the transverse support. Owing to the design of the plate-like retaining profiles, the hook-in region can be produced cost-effectively by simple punching or laser processing. The left and right retaining profiles, which are arranged at a distance from each other, result in a secure support and tilt-resistant arrangement of the load suspension element. Furthermore, the resistance to tilting is made possible by the retaining element which engages at the lower end of the transverse strut and is intended for securing the load suspension element.

Furthermore, it is preferably provided that the left and right retaining profiles are spaced apart from each other at least by a transverse strut and a contact area and, in particular, by a spacer element. As a result, a simple and also stiff supporting structure produced from individual sheet-metal parts can be formed. Sheet-metal parts of this type may be produced as punching or laser processing parts. This results in a lightweight construction.

Furthermore, it is preferably provided that the contact area is designed as a punched and bent part which has a receiving surface and a spacer section at an angle with respect thereto. This further reduces the number of components for the load suspension element. Furthermore, the rigidity can be increased. The reduction in the number of components also makes it possible for installation to be more cost effective.

Furthermore, it is preferably provided that a section of the left and right retaining profiles of the load suspension element, which section points in the vertical direction and faces a load, and in particular the spacer section of the contact area are inclined with respect to the lifting apparatus and are arranged at an angle of greater than 90° with respect to the supporting surface. This arrangement makes it possible to prevent the load being damaged, in particular a wheel hub when engagement takes place under the wheels. A greater clearance for receiving the load than in the case of an orientation pointing vertically upwards is therefore provided.

Furthermore, it is preferably provided that the load suspension element by means of the retaining profiles, the transverse strut and the contact area are arranged with respect to one another in an open construction with clearances. This open construction permits a saving on weight and simple production. Furthermore, hot galvanizing can be provided through the open construction without having to insert additional apertures or recesses into the load suspension element.

Figure 2:
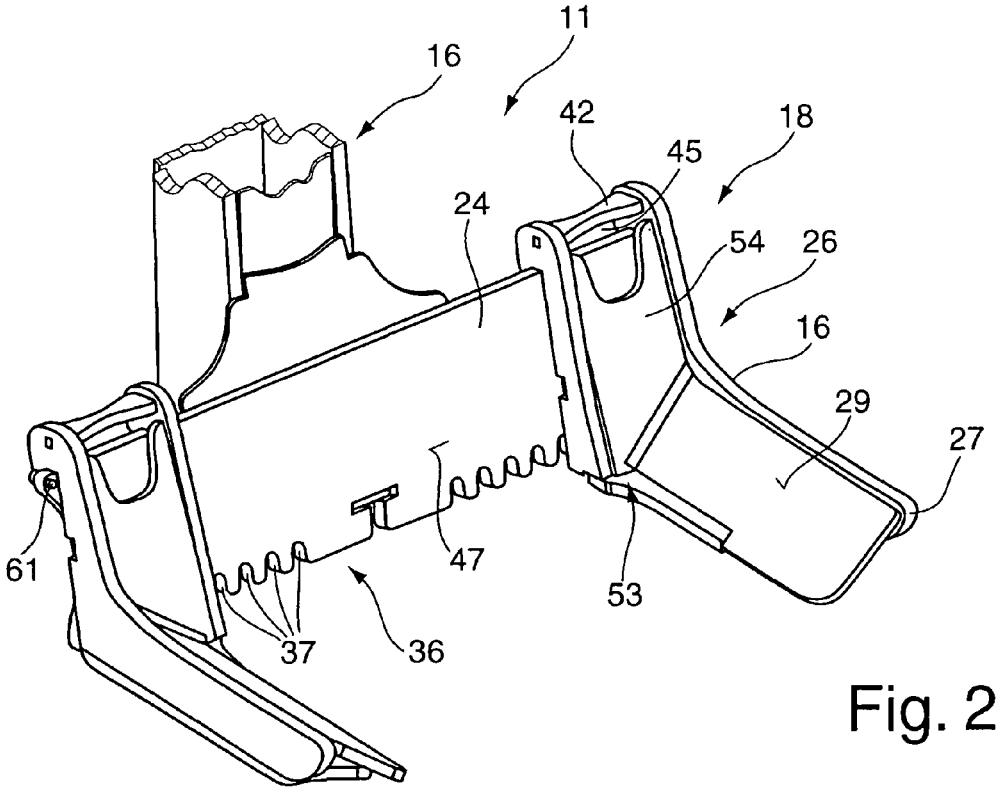
Figure 3:
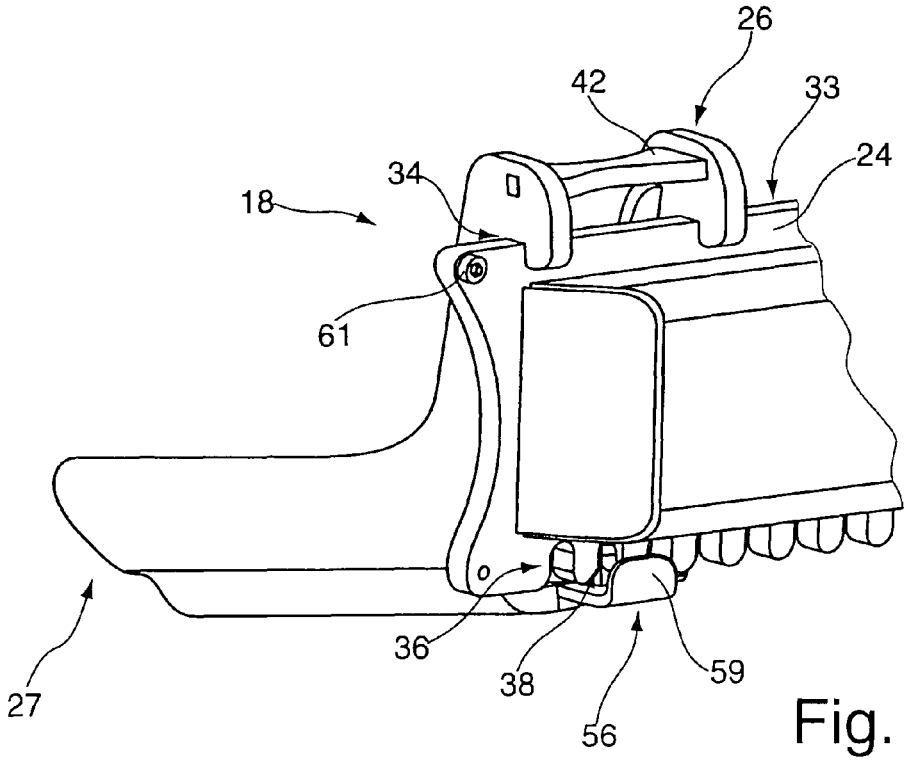
Figure 4:
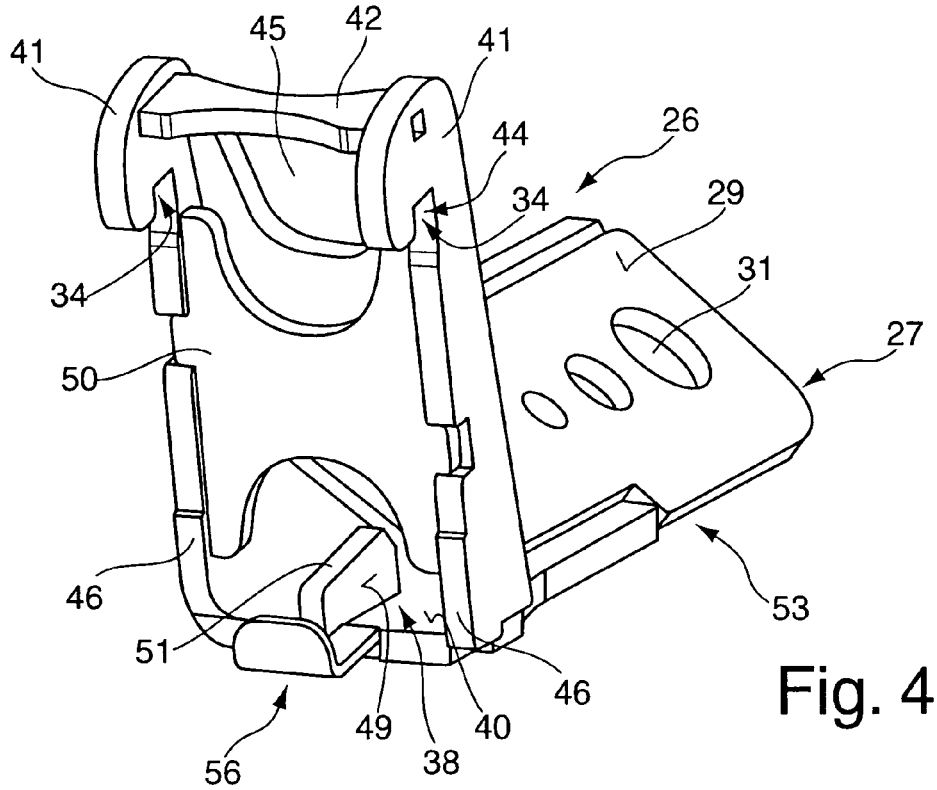
Figure 5:
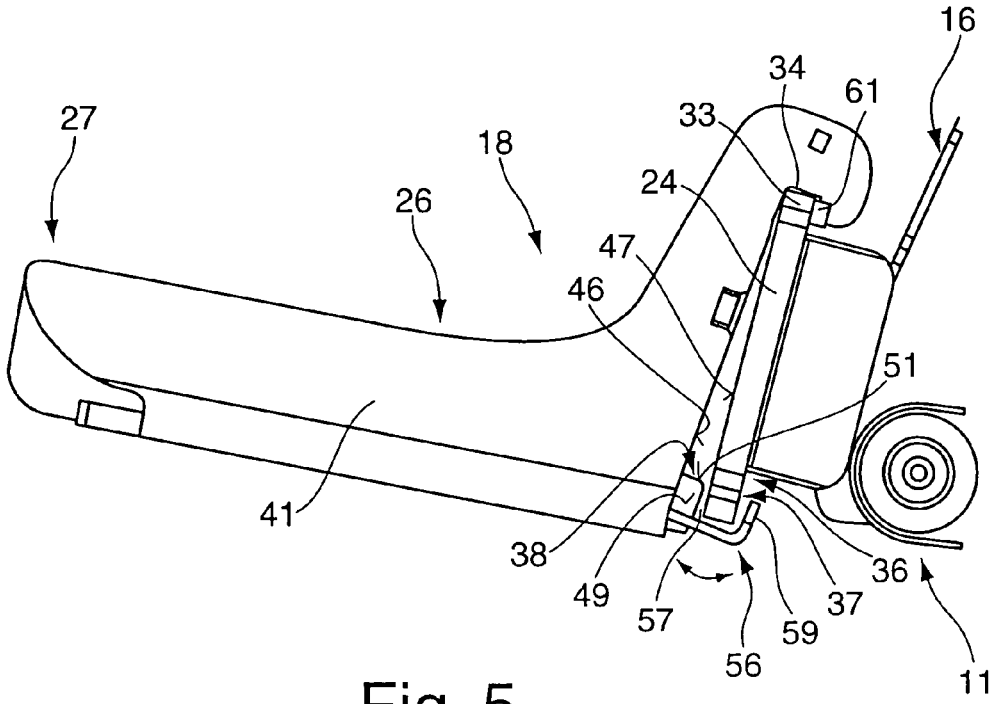

The invention and further advantageous embodiments and developments of the same are described and explained in more detail below with reference to the examples illustrated in the drawings. According to the invention, the features to be gathered from the description and the drawings can be used individually by themselves or a number of them can be used in any desired combination. In the drawings:

FIG. 1 shows a perspective view of a mobile lifting apparatus with a load suspension means according to the invention, FIG. 2 shows a perspective view of the load suspension means according to the invention from the front, FIG. 3 shows a perspective view of the load suspension means according to the invention from the rear, FIG. 4 shows a perspective illustration of a load suspension element of the load suspension means according to the invention, and FIG. 5 shows a schematic side view of the load suspension means in a displacement position.

FIG. 1 illustrates perspectively a lifting apparatus 11 which is suitable for mobile use. For this purpose, for example, a steerable moving mechanism 12 is provided on the basic framework 14. A lifting unit 17 which comprises an electric, electro-hydraulic, hydraulic or mechanical drive is provided in a lifting column 16 arranged on the basic framework 14. By means of this drive, a load suspension means 18 is transferred from a lower inoperative position into a working position 21. Furthermore, a control unit 22 is provided on the lifting column 16 and is connected via a supply line (not illustrated specifically) to a power source, a further lifting apparatus or a further control unit.

The load suspension means 18 comprises a transverse support 24 on which, according to the exemplary embodiment, two load suspension elements 26 are provided. In the exemplary embodiment, the load suspension elements 26 are designed as fork-shaped wheel-gripping elements which comprise load suspension forks 27. Receiving surfaces 29 are provided on said load suspension forks 27 and are oriented such that they face each other in order to engage on the wheel in a sheetlike manner. The receiving surfaces 29 have holes 31 or apertures which serve to increase the adhesion to a tyre profile and at the same time permit a reduction in weight.

FIGS. 2 and 3 illustrate the load suspension means 18 according to the invention perspectively from the front and rear. By means of the upper edge region or the horizontally running edges, the transverse support 24 forms a supporting region 33 for the load suspension element 26. The latter has a hook-in region 34 which is designed as a hook-in hook or hook-in clamp, with a U-shaped depression being formed so as to engage behind the supporting region 33. Opposite the supporting region 33, a position-securing region 36 for the load suspension elements 26 is formed on the lower edge. Said position-securing region 36 is formed by a plurality of retaining elements 37 which are provided, for example, in the form of U-shaped recesses and are preferably arranged at a regular distance from one another. The transitions from one retaining element 37 to the adjacent element are preferably of rounded design, thus producing an introductory region in order to permit easier engagement of a retaining element 38, which is preferably designed as a cam and is arranged on the load suspension element 26. The retaining elements 37 and the retaining element 38 form form-fitting retaining elements which permit a secured load suspension position of the load suspension element 26 with respect to the transverse support 24 according to FIGS. 2 and 3.

FIG. 4 illustrates a perspective view of a load suspension element 26. The hook-in region 34 is formed by a left and right retaining profile 41 which are spaced apart from each other by a web 42. Below the web 42, a hook-in region 34 is formed in a U-shaped manner on each retaining profile 41. Said hook-in region 34 is designed to be greater than the thickness of the transverse support 34 and has an additional free surface 44. A respective supporting section 46 is provided at the lower end of the retaining profile 41, said supporting section being formed by the end surfaces of the retaining profiles 41 which, in a use position, bear against and are supported on a side surface 47 of the transverse support 24. Between the two supporting sections 46, the retaining element 38, which is designed as a cam, is arranged on a lower supporting section 40 of the load suspension element 26. Said section is preferably connected as a single part to the retaining profile 41 and is produced from a material as a sheet-metal punched part or sheet-metal cut part. Said retaining element 38 has side surfaces 49 which bear against the long limbs of the retaining device 37. An end surface 51 of the retaining element 38, which end surface faces the hook-in region 34, is preferably of inclined design such that, during a pivoting movement, which is described in more detail below, a more rapid and simple release of the retaining element 38 from the U-shaped retaining elements 37 is made possible. A lift-off safeguard 56 is provided, assigned to the retaining element 38 and to the supporting section 46. Said lift-off safeguard 56 is of L-shaped design. The function of the lift-off safeguard 56 is described in more detail with reference to FIG. 5 which shows an unsecured load suspension position of the load suspension element 26. As an alternative to the illustrated embodiment of the retaining element 38 and the lift-off safeguard 56, the retaining element 38 and the lift-off safeguard 56 can be combined in one component. In this case, the geometry of the retaining device 38 and the function of the lift-off safeguard 56 are retained. In a departure from the illustration in FIGS. 3 and 4, a tab 59 of the lift-off safeguard 56 is preferably restricted to the width of the retaining element 38, preferably to the width of the end surface 51 of the retaining element 38. The function and safety are retained in this case. As a result, a further simplification in the production can be provided, since the lift-off safeguard 56 and the retaining element 38 are produced from one material as a sheet-metal punched or sheet-metal cut part.

In a secured load suspension position, as illustrated by way of example in FIG. 3, the retaining element 38 on the load suspension element 26 engages in the retaining element 37 of the transverse support 24. As a result, the load suspension element 26 is secured against tilting due to transverse forces. At the same time, displacement of the load suspension element 26 longitudinally with respect to the transverse support 24 is prevented. Furthermore, in this load suspension position, the lift-off safeguard 56 acts in such a manner that a distance between the lift-off safeguard 56 and the lower edge of the transverse support 24 is smaller than an engagement depth of the hook-in region 34.

In order to displace the load suspension element 26 from a first position (FIG. 3) into a second position (FIG. 5), first of all lifting of the load suspension forks 27 takes place. As a result, the retaining element 38 is disengaged from the retaining element 37. At the same time, the pivoting movement of the load suspension element 26 about a pivot axis, which is formed by the hook-in region 34 and the supporting region 33, or the raising by way of the lower region of the load suspension element 26, which region is adjacent to the transverse strut 24, is restricted by the lift-off safeguard 56. In this case, an L-shaped section or tab 59 blocks the pivoting movement. This position is illustrated in FIG. 5. A pivoting movement of this type about the supporting region 33 of the transverse support 24 is assisted by the free surface 44 arranged on the hook-in region 34.

So that the load suspension element 26 can be displaced longitudinally with respect to the transverse support, a distance of an end side 57 facing the transverse support from the tab 59 of the lift-off safeguard, which tab is oriented essentially parallel, is spaced apart in such a manner that at least the wall thickness of the transverse support 24 is encompassed. By displacement of the load suspension element 26, the load suspension fork 27 is lowered and the retaining element 38 engages automatically on account of the dead weight into the retaining element 37, as a result of which the newly set position of the load suspension element 26 is automatically secured.

A lock 61 is provided at the respective outer, upper end of the transverse support 34. Said lock 31 secures the load suspension element or elements 26 with respect to the transverse support 24. The lock 61 is preferably designed such that it can be released for the purpose of exchanging the load suspension elements 26.

The load suspension element 16 illustrated in FIGS. 1 to 5 has an open construction through the individual sheet-metal parts which are produced as punched parts, bent and punched parts or laser processing parts. An open construction of this type results in a lightweight construction, with stability with respect to the load suspension means being provided at the same time. At the same time, a reduction in costs can be obtained by saving on material. The load suspension element 26 is formed, for example, by a left and right retaining profile 41 and a transverse strut 42, a spacer element 50 and a contact area 53. The spacer element 50 is provided in particular if an increased load-bearing capacity is required. Said contact area 53 comprises a receiving surface 29 and a spacer section 54 arranged at an angle with respect thereto. Between an upper end of the spacer section 54 and the transverse strut 42, on the one hand, and the transverse strut 42 and the spacer element 50, on the other hand, clearances 45, for example, are provided which bring about a saving on material and at the same time permit easier hot galvanizing. By means of the retaining profiles 41 of plate-like design, the hook-in region 34 can be formed by simple punching or laser processing.

Furthermore, the individual structural elements for forming the load suspension element 26 have an increased supporting force by means of the L-shaped configuration of a respectively outer retaining profile 41 for a load suspension element 26 together with the arrangement of the contact area 27, since said retaining profile 41 is composed of one piece and not, as hitherto, of a plurality of parts and held together by weld seams. A front end of a horizontal section of a respectively outer retaining profile 41 has a geometry which tapers from a lower edge to the upper edge and comprises a curvature. This firstly has the advantage of saving on material. Secondly, the risk of injury, in particular with the load suspension element 26 raised, is reduced. Furthermore, this continuously round transition, which is also formed between further sections of the retaining profiles 41 that run rectilinearly, results in force flux lines which avoid stress concentrations.

As an alternative to the obliquely inclined load suspension surface 29, it is provided that the load suspension surface 29 is oriented horizontally. This enables the creation of a flat load-bearing fork which also includes the advantages of the previously described load suspension means according to the invention.

All of the features described above are each essential to the invention by themselves and can be combined with one another as desired.

The invention claimed is:

1. Load suspension means for a lifting apparatus, which can be fitted on a lifting column of the lifting apparatus, comprising a transverse support, at least one load suspension element which is arranged thereon and is displaceable along the transverse support for adjustment to a load suspension point on an object to be raised, the load suspension element has a hook-in region which acts on the supporting region of the transverse support and, opposite thereto, comprises supporting sections bearing against the position-securing region, the load suspension element and the transverse support each have at least one retaining element which engage in a form-fitting manner in one another in a secured load suspension position of the load suspension element with respect to the transverse support, the at least one load suspension element is transferable for adjustment to the load suspension point by a pivoting movement from a secured load suspension position without a tool into a position for a displaceable movement along the transverse support and then into a secured load suspension position without a tool, a lift-off safeguard enables the load suspension element to lift off from the lower edge of the transverse support by the pivot movement about a pivot axis which is formed by the hook-in region and the supporting region, which movement is restricted by an L-shaped section of the lift-off safeguard, to allow the retaining elements to disengage from each other, whereby the load suspension element is displaceable along the transverse support, and further by pivoting the load suspension element in a direction opposite to said pivot movement from said displaceable movement along the transverse support, after displacing the load suspension element along the transverse support, enables the retaining elements to engage each other in a secured suspension load position.

2. Load suspension means according to claim 1, wherein two load suspension elements, which are designed as load suspension forks, are provided on the transverse support such that a distance between said suspension forks can be adjusted to a size of a wheel.

3. Load suspension means according to claim 2, wherein a right and a left load suspension fork are formed and each load suspension fork has a receiving surface directed towards the other.

4. Load suspension means according to claim 3, wherein the receiving surface of the load suspension forks has holes or profilings.

5. Load suspension means according to claim 3, wherein a left retaining profile and a right retaining profile are spaced apart from each other at least by a transverse strut and a contact area and a spacer element.

6. Load suspension means according to claim 4, wherein a contact area is designed as a punched and bent part which has a supporting surface and a spacer section at an angle with respect thereto.

7. Load suspension means according to claim 4, wherein a section of a left retaining profile and a right retaining profile, which section points in the vertical direction and faces a load, and the spacer section are inclined with respect to the lifting apparatus and are at an angle of more than 90° with respect to the supporting surface.

8. Load suspension means according to claim 1, wherein the retaining element of the transverse support, which is provided as a U-shaped recess and is open at the lower edge, engages with a further retaining element of the load suspension element, which is provided as a cam.

9. Load suspension means according to claim 1, wherein a plurality of retaining elements are arranged at regular distances from one another and form a position-securing region are provided on a lower side of the transverse support.

10. Load suspension means according to claim 1, wherein side surfaces which are oriented parallel to the long limbs of the retaining element, designed as a U-shaped recess, and are designed for bearing and are provided on the retaining element of the load suspension element.

11. Load suspension means according to claim 1, wherein a retaining element of the load suspension element protrudes in relation to the supporting section in the direction of the position-securing region of the transverse support.

12. Load suspension means according to claim 1, wherein the lift-off safeguard is of L-shaped design and is arranged in a mirror-inverted manner with respect to a hook-in region on the load suspension element.

13. Load suspension means according to claim 1, wherein the retaining element and the lift-off safeguard are designed as a single part.

14. Load suspension means according to claim 1, wherein the pivoting movement takes place about a pivot axis which is formed on the transverse support by a hook-in region of the load suspension element and of the supporting region.

15. Load suspension means according to claim 1, wherein the pivoting movement of the load suspension element comprises a region of between 0.5° to 20° about a pivot axis.

16. Load suspension means according to claim 1, wherein the transverse support at the outer end in each case of the supporting region has a releasable lock.

17. Load suspension means according to claim 1, wherein the load suspension element has a left retaining profile and a right retaining profile on each of which a hook-in region is provided for engagement on the supporting region of the transverse support.

18. Load suspension means according to claim 1, wherein the load suspension element comprises a retaining profile, a transverse strut and a contact area arranged in an open construction with clearances.

* * * * *